US007168797B2

(12) United States Patent
Arai et al.

(10) Patent No.: US 7,168,797 B2
(45) Date of Patent: Jan. 30, 2007

(54) INK CONTAINER

(75) Inventors: Masakatsu Arai, Ibaraki-ken (JP); Kaoru Kimura, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 179 days.

(21) Appl. No.: 10/778,196

(22) Filed: Feb. 17, 2004

(65) Prior Publication Data

US 2004/0165046 A1 Aug. 26, 2004

(30) Foreign Application Priority Data

Feb. 14, 2003 (JP) ..... 2003-036090
Jan. 9, 2004 (JP) ..... 2004-004234

(51) Int. Cl.
*B41J 2/175* (2006.01)

(52) U.S. Cl. ..... 347/86

(58) Field of Classification Search ..... 347/19, 347/86, 87; 424/448
See application file for complete search history.

(56) References Cited

U.S. PATENT DOCUMENTS 5,853,750 A * 12/1998 Dietz et al. ..... 424/448
6,144,305 A 11/2000 Kakuda et al. ..... 340/651
6,155,678 A * 12/2000 Komplin et al. ..... 347/86
6,190,181 B1 2/2001 Affolter et al. ..... 439/70
6,249,440 B1 6/2001 Affolter ..... 361/769
6,322,205 B1 11/2001 Childers et al.
6,416,152 B1 * 7/2002 Matsuzaki et al. ..... 347/19
6,530,519 B1 3/2003 Suzuki
6,588,871 B2 * 7/2003 Studholme et al. ..... 347/19
6,634,738 B1 * 10/2003 Shinada et al. ..... 347/86
6,702,215 B2 * 3/2004 Stamm et al. ..... 242/348
6,755,516 B2 * 6/2004 Hanson et al. ..... 347/86
2002/0021252 A1 2/2002 Schremmer et al. ..... 343/702

FOREIGN PATENT DOCUMENTS

DE 0264894 A2 * 10/1987
EP 1 092 546 A2 4/2001
JP 10-133529 A 5/1998

* cited by examiner

*Primary Examiner*—Anh T. N. Vo
(74) *Attorney, Agent, or Firm*—Frommer Lawrence & Haug, LLP; Matthew K. Ryan, Esq.

(57) ABSTRACT

An ink container includes an ink container body and a memory attached to the ink container body for storing predetermined information. The memory is bonded to a part of the surface of the ink container body at its surface opposed to the surface of the ink container body over an area not larger than 90% of its surface facing toward said part of the surface of the ink container body.

12 Claims, 6 Drawing Sheets

INK CONTAINER

BACKGROUND OF THE INVENTION

1. Field of the Invention

This invention relates to an ink container with a storage means for storing predetermined information.

2. Description of the Related Art

In the past, a removable ink container has been used in a stencil printer since it is easy to handle. When ink in the container has been consumed, the container is removed from the stencil printer to be discarded or recycled and a new ink container is mounted on the stencil printer. In such ink containers, there has been proposed, for instance, in Japanese Unexamined Patent Publication No. 10(1998)-133529, an ink container in which a storage means such as a memory IC is provided and the ink consumption and/or the dates of use in the stencil printer are stored. By reading out the ink consumption and/or the dates of use stored in the storage means, the state of use and or the like of the stencil printer can be known and used.

In the method proposed in U.S. Pat. No. 6,530,519, information on viscosity and/or color of ink accommodated in the ink container is stored in a memory IC and the stencil printer controls the press pressure during printing on the basis of the information on viscosity and/or color of ink accommodated in the ink container. Further, there has been proposed a method in which the remainder of ink in the container is stored in a memory IC and an alarm is given when the remainder of ink in the container is minimized.

However, the ink container disclosed in Japanese Unexamined Patent Publication No. 10(1998)-133529 is disadvantageous in that since the storage means is embedded in the ink container body, it is difficult to separate the storage means from the ink container body when the empty ink containers are discarded or recycled. The ink container disclosed in U.S. Pat. No. 6,530,519 is provided with a circuit board which carries a memory IC and directly bonded to the ink container body. Also, in this ink container, it is difficult to separate the memory IC from the ink container body and separation of the memory IC by force can result in damage on the memory IC depending on the state of bonding of the circuit board to the ink container body.

SUMMARY OF THE INVENTION

In view of the foregoing observations and description, the primary object of the present invention is to provide an ink container with a storage means for storing predetermined information in which the storage means can be easily removed from the ink container body after ink accommodated therein is consumed.

In accordance with a first aspect of the present invention, there is provided an ink container comprising an ink container body and a storage means attached to the ink container body for storing predetermined information, wherein the storage means is bonded to a part of the surface of the ink container body at its surface opposed to the surface of the ink container body over an area not larger than 90% of its surface facing toward said part of the surface of the ink container body.

The "storage means" may be any storage means so long as information stored therein is readable or readable and writable from external devices.

It is preferred that the storage means be bonded to the part of the surface of the ink container body by an adhesive, the adhesion of the adhesive be 20N/25 mm and at the same time, the storage means be bonded to a part of the surface of the ink container body at its surface opposed to the surface of the ink container body over an area not smaller than 30% and not larger than 90% of its surface facing toward said part of the surface of the ink container body.

Further, a part or the whole of outer periphery of said surface of the storage means facing toward the part of the surface of the ink container body is preferably not bonded to the surface of the ink container body.

In accordance with a second aspect of the present invention, there is provided an ink container comprising an ink container body and a storage means attached to the ink container body for storing predetermined information, wherein the storage means is bonded to a surface of the ink container body at its surface opposed to the surface of the ink container body by way of a protrusion means which is smaller in area than a surface of the storage means facing toward the part of the surface of the ink container body.

The protrusion means may be formed either integrally with said storage means or the ink container body or as a member separate from said storage means and the ink container body.

For example, the protrusion means may comprise a plurality of ribs formed at predetermined spaces from each other.

It is preferred that the ribs are rounded at least one of the end portions respectively in contact with the ink container body and the storage means.

Otherwise, the protrusion means may comprise a plurality of projections which are brought into contact with the ink container body or the storage means at a point.

It is preferred that the projections are rounded at least one of the end portions respectively in contact with the ink container body and the storage means.

In one embodiment, the protrusion means is absent in positions opposed to a part or the whole of outer periphery of said surface of the storage means facing toward the part of the surface of the ink container body.

That the ribs are rounded at least one of the end portions means that at least one of the end portions of each of the ribs has a rounded cross-section, and that the projections are rounded at least one of the end portions means that at least one of the opposite end portions of each of the projections is, for instance, semispherical. Or, each of the projections may be spherical as a whole. That is, the end portion may be of any shape so long as the end portion is partly rounded.

In accordance with a third aspect of the present invention, there is provided an ink container comprising an ink container body and a storage means attached to the ink container body for storing predetermined information, wherein the storage means is mounted on the ink container body by way of a mounting member which is removably mounted on the ink container body.

In the ink container in accordance with the first aspect of the present invention where the storage means is bonded to a part of the surface of the ink container body at its surface opposed to the surface of the ink container body over an area not larger than 90% of its surface facing toward said part of the surface of the ink container body, the storage means can be easily removed from the ink container body and easily separated therefrom after ink accommodated therein is consumed.

When the storage means is bonded to the part of the surface of the ink container body by an adhesive, the adhesion of the adhesive is 20N/25 mm and at the same time, the storage means is bonded to a part of the surface of the ink container body at its surface opposed to the surface of the ink container body over an area not smaller than 30% and not larger than 90% of its surface facing toward said part of the surface of the ink container body, damage on the storage means upon separation of the storage means from the ink container body can be prevented, and at the same time, inadvertent separation of the storage means from the ink container body on impact, which can result in communication trouble in a stencil printer or the like, can be prevented.

When a part or the whole of outer periphery of said surface of the storage means facing toward the part of the surface of the ink container body is not bonded to the surface of the ink container body, the storage means can be removed from the ink container body by inserting a removal member from the outer periphery of the surface of the storage means which is not bonded to the surface of the ink container body and accordingly the storage means can be more easily removed from the ink container body.

In the ink container in accordance with the second aspect of the present invention where the storage means is bonded to a surface of the ink container body at its surface opposed to the surface of the ink container body by way of a protrusion means which is smaller in area than a surface of the storage means facing toward the part of the surface of the ink container body, the storage means can be easily removed from the ink container body and easily separated therefrom after ink accommodated therein is consumed as in the ink container in accordance with the first aspect.

When the protrusion means comprises a plurality of ribs formed at predetermined spaces from each other or a plurality of projections which are brought into contact with the ink container body or the storage means at a point, the storage means can be stably held in place and at the same time, the storage means can be easily removed from the ink container body after ink accommodated therein is consumed.

When the protrusion means is absent in positions opposed to a part or the whole of outer periphery of said surface of the storage means facing toward the part of the surface of the ink container body, the storage means can be removed from the ink container body by inserting a removal member from the outer periphery of the surface of the storage means which is not bonded to the surface of the ink container body and accordingly the storage means can be more easily removed from the ink container body.

Further, when the ribs or the projections forming the protrusion means are rounded at least one of the end portions respectively in contact with the ink container body and the storage means, the storage means can be further easily removed from the ink container body.

In the ink container in accordance with the third aspect of the present invention where the storage means is mounted on the ink container body by way of a mounting member which is removably mounted on the ink container body, the storage means can be easily removed from the ink container body and easily separated therefrom after ink accommodated therein is consumed as in the ink containers in accordance with the first and second aspects of the present invention.

DESCRIPTION OF THE PREFERRED EMBODIMENTS

Figure 1:
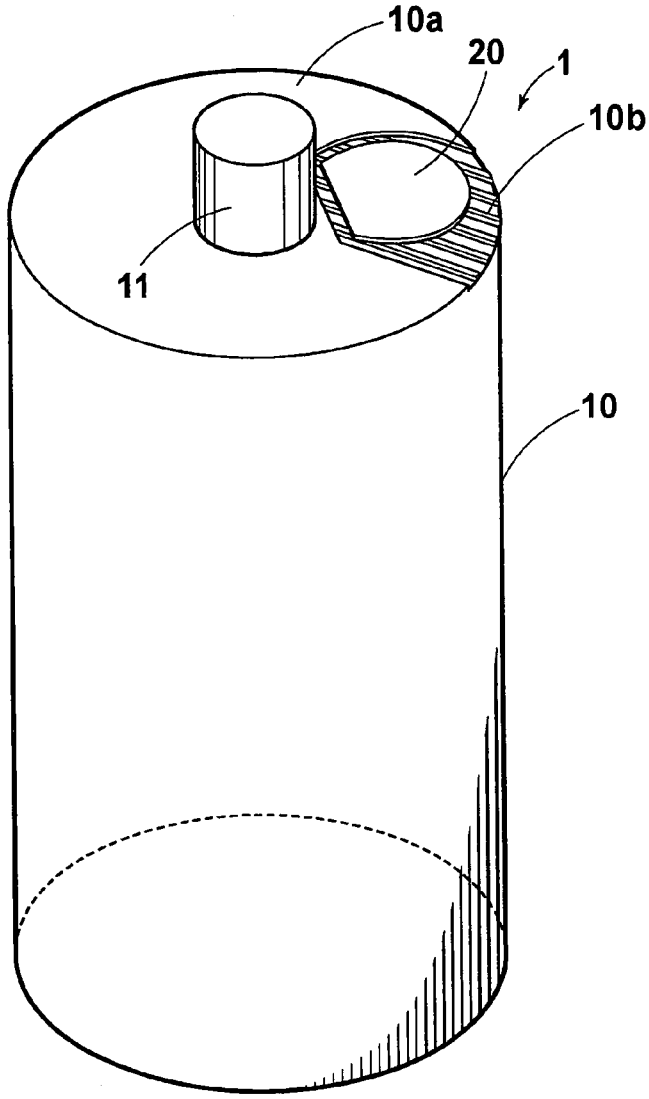
FIG. 1 is a perspective view showing an ink container in accordance with an embodiment of the present invention.

As shown in FIG. 1, an ink container 1 comprises an ink container body 10 which is formed of synthetic resin and is substantially cylindrical in shape and a storage means 20 for storing predetermined information. An ink discharge port 11 through which ink in the ink container body 10 is discharged is provided on an upper end face 10*a* of the ink container body 10. A memory site 10*b* where the storage means 20 is provided is formed on apart of the upper end face 10*a* of the ink container body 10. As the storage means 20, for instance, a base sheet on which a memory IC is mounted, that on which a bar code is recorded or that on which characters or symbols are recorded may be employed.

Figure 2:
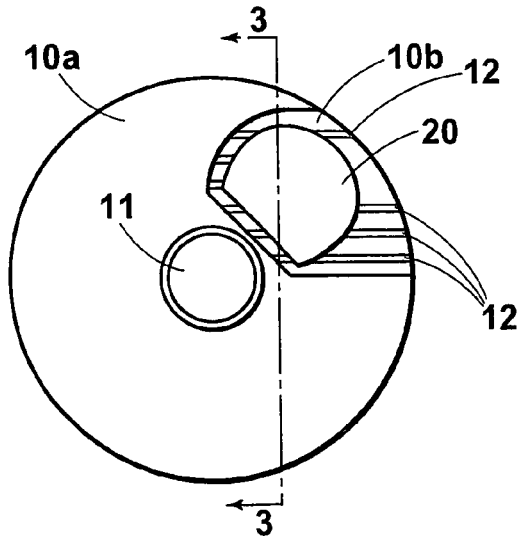
FIG. 2 is a plan view of the ink container shown in FIG. 1.
Figure 3:
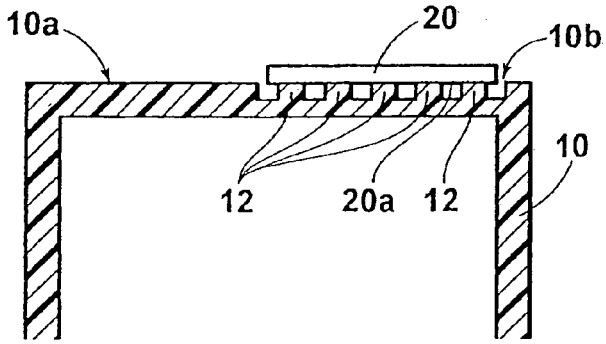
FIG. 3 is a fragmentary cross-sectional view showing a part of the ink container shown in FIG. 1.

FIG. 2 is a plan view of the ink container 1 and FIG. 3 is a cross-sectional view taken along line 3—3 in FIG. 2. As can be understood from FIG. 2, the memory site 10*b* is formed on a part of the upper end face 10*a*. That is, a recess is formed in the upper end face 10*a*, and the storage means 20 are bonded to ribs 12 formed on the bottom surface of the recess as shown in FIG. 3.

In the ink container 1 of this embodiment, the storage means 20 can be easily removed from the ink container body 10 and easily separated therefrom after ink accommodated therein is consumed since the storage means 20 is bonded to the ink container body 10 by way of the ribs 12 formed in the memory site 10*b*.

Figure 4:
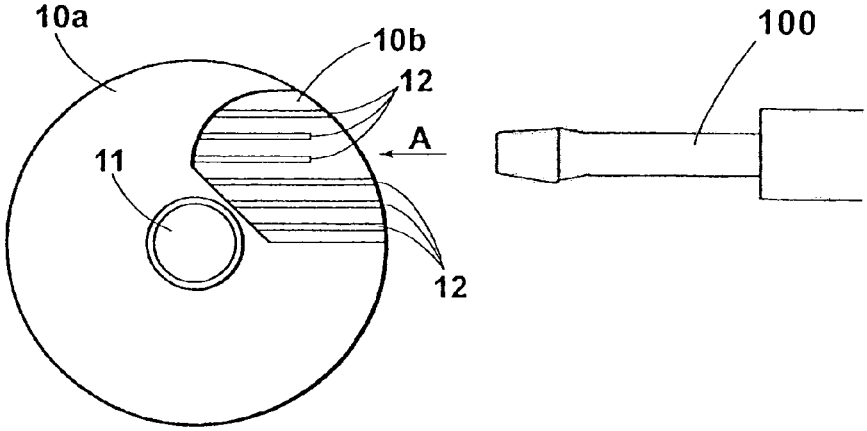
FIG. 4 is a plan view showing the ink container shown in FIG. 1 with the storage means removed.

As clearly shown in FIG. 4 where the ink container 1 is shown with the storage means 20 removed from the ink container body 10, no rib 12 is formed in positions opposed to a part of the outer periphery of the storage means 20.

Forming the ribs 12 in this manner is advantageous in that the storage means 20 can be removed from the ink container body 10 by inserting a removal member 100 from the outer periphery of the surface of the storage means 20 which is not bonded to the surface of the ink container body 10 and accordingly the storage means 20 can be more easily removed from the ink container body 10. Further when the ribs 12 are formed so that they extend in the direction of arrow A in which the removal member 100 is inserted as shown in FIG. 4, the storage means 20 can be more easily removed from the ink container body 10 as compared with when the ribs 12 are formed so that they extend, for instance, in perpendicular to the direction of arrow A.

Figure 5:
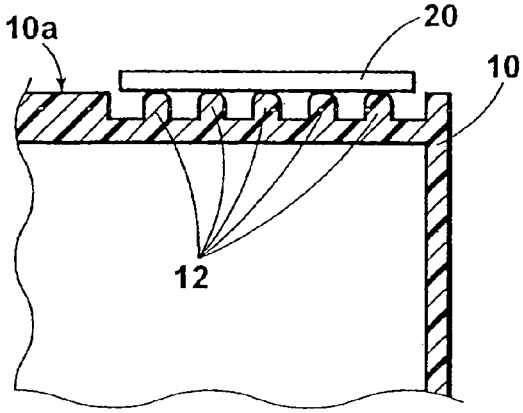
FIG. 5 is a fragmentary cross-sectional view for illustrating a modification of the ink container of the embodiment.

The end portion of each rib 12 in contact with the memory means 20 may be rounded as shown in FIG. 5.

Figure 6:
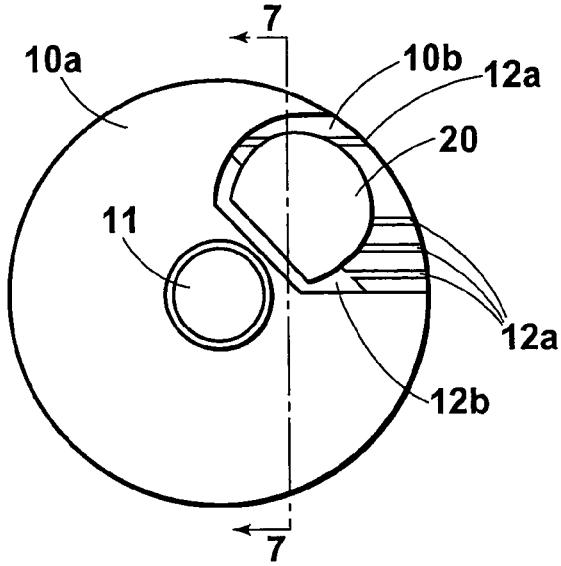
FIG. 6 is a plan view showing an ink container in accordance with another modification of the embodiment.
Figure 7:
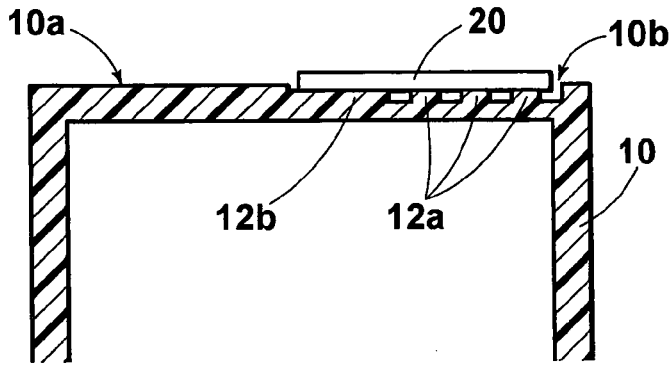
FIG. 7 is a fragmentary cross-sectional taken along line 7—7 in FIG. 6.

It is possible to form ribs 12*a* and a flat portion 12*b* and to bond the storage means to the top surfaces of the ribs 12*a* and the flat portion 12*b* as shown in FIG. 6. As shown in FIG. 7, which is a cross-sectional view taken along line 7—7 in FIG. 6, the top surfaces of the ribs 12*a* and the flat portion 12*b* are flush with each other.

Figure 8:
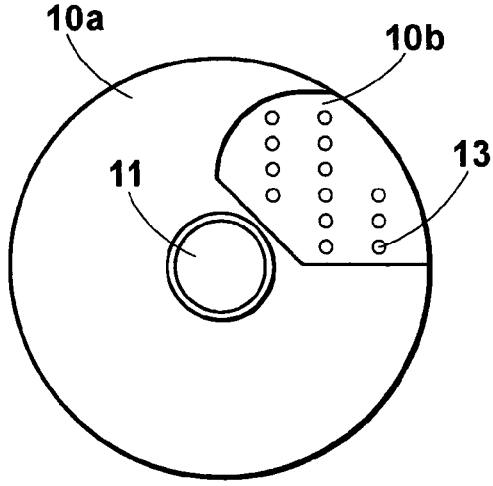
FIG. 8 is a plan view showing an ink container in accordance with still another modification of the embodiment.

The memory means 20 may be bonded to the ink container body 10 by way of a plurality of spot projections 13 formed in the memory site 10*b* in place of the ribs 12 (12*a*) as shown in FIG. 8. The end portion of each spot projection 13 in contact with the memory means 20 may be also rounded. Also in this case, no spot projection 13 may be formed in positions opposed to a part of the outer periphery of the storage means 20 as shown in FIG. 8.

The storage means 20 may be directly bonded to the memory site 10*b*, for instance, by adhesive without forming a protrusion means (e.g., the ribs 12 (12*a*) or the spot projections 13). However, in this case, the storage means 20 is bonded to the memory site 10*b* of the ink container body 10 over an area not larger than 90% of its surface 20*a* (FIG. 3) facing toward the memory site 10*b*.

Also in the case where the storage means 20 is directly bonded to the memory site 10*b* by adhesive, it is preferred that a part or the whole of outer periphery of the storage means 20 facing toward the memory site 10*b* of the ink container body 10 be not bonded to the surface of the memory site 10*b*.

An experiment for proving that the storage means 20 was to be bonded to the ink container body 10 over an area not smaller than 30% and not larger than 90% of its surface 20*a* facing toward the ink container body 10 was carried out in the following manner. The result was as shown in the following table 1.

Figure 9:
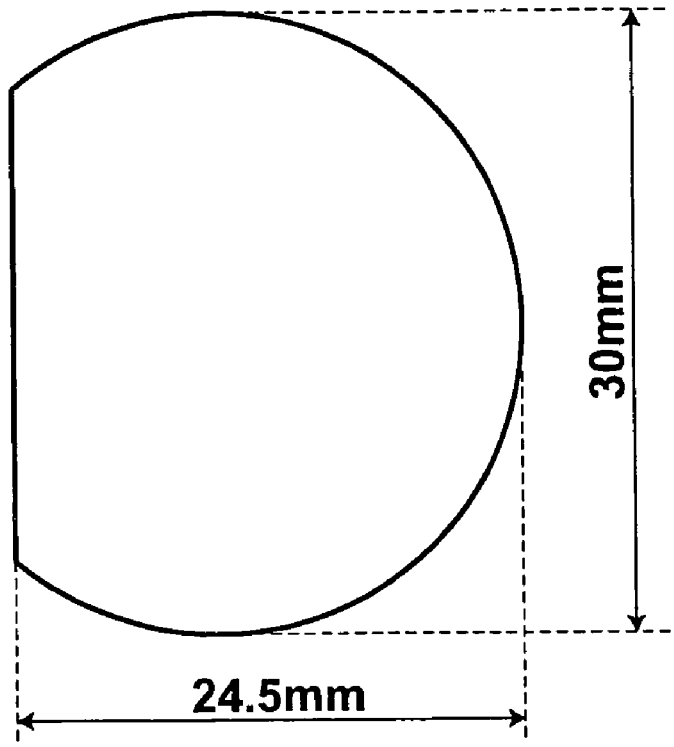
FIG. 9 is a plan view showing the storage means employed in the experiment for evaluating the peeling easiness.

That is, the bond strengths were measured with the bonding area set to 20% to 100% of the surface 20*a* of the storage means 20 facing toward the ink container body 10. The bond strengths were measured by the use of a SHIMADZU AGS500D (with the load cell for 50N) with the storage means 20 peeled off the ink container body 10 from a state horizontally bonded to the ink container body 10 (a so-called 180□peeling). The rate of pulling was 300 mm/min and the environmental temperature and humidity were 23° C. and 50% RH. The storage means 20 was as shown in FIG. 9, and the bond strength means a maximum bond strength encountered when the storage means 20 was fully peeled off. The adhesion of the adhesive for bonding the storage means 20 to the container body 10 was 20N/25 mm and the storage means 20 was bonded to the container body 10 by the use of an acrylic adhesive. The adhesion of the acrylic adhesive was that to polypropylene. The peeling easiness of the storage means 20 was evaluated for each bonding area on the basis of the measured bond strength and tabulated in the following table.

TABLE

| bonding area (%) | bond strength (N) | evaluation |
|---|---|---|
| 100 | 21.9 | X |
| 95 | 16.5 | X |
| 90 | 10.5 | ○ |
| 80 | 6.7 | ○ |
| 70 | 6.8 | ○ |
| 60 | 4.7 | ○ |
| 40 | 4.1 | ○ |

TABLE-continued

| bonding area (%) | bond strength (N) | evaluation |
|---|---|---|
| 30 | 3.8 | ○ |
| 25 | 2.9 | X |
| 20 | 2.5 | X |

X represents that the storage means is difficult to peel off or is readily peeled off.
○ represents that the storage means is easy to peel off and cannot be readily peeled off.

As can be understood from the table, it is preferred the bonding area be not smaller than 30% and not larger than 90% of the surface of the storage means 20 facing toward the surface of the ink container body 10 in order to bond the storage means 20 to be easily peeled off the ink container body 10 and not to be readily peeled off the ink container body 10 on impact.

Figure 10A:
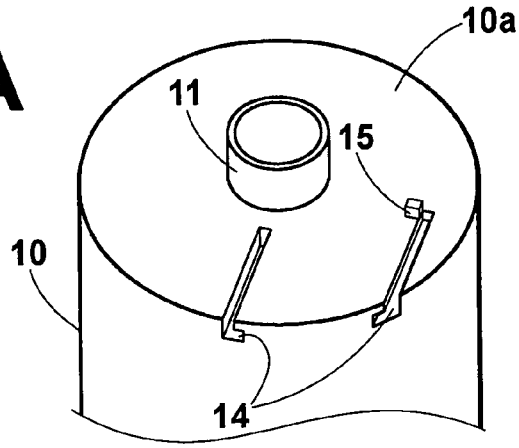
FIGS. 10A and 10B are views for illustrating another embodiment of the present invention.
Figure 10B:
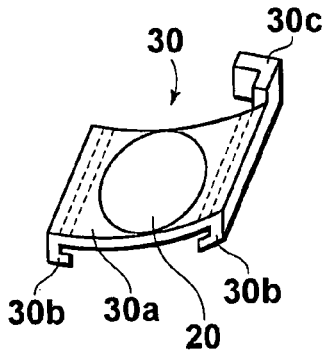

The storage means 20 may be mounted on the ink container body 10 by way of a mounting member 30 which is removably mounted on the upper end face 10*a* of the ink container body 10 as shown in FIGS. 10A and 10B. That is, as shown in FIG. 10A, a pair of grooves 14 and a projection 15 are formed in the upper surface 10*a* of the ink container body 10. As shown in FIG. 10B, the mounting member 30 comprises a resin plate 30*a* conforming to the upper end face 10*a* of the ink container body 10, and a pair of first fixing portions 30*b* which are respectively engaged with the grooves 14 and a second fixing portion 30*c* which is engaged with the projection 15 are formed in the resin plate 30*a*. The storage means 20 is carried by the resin plate 30*a* and is fixed to the upper end face 10*a* of the ink container body 10 by mounting the mounting member 30 on the upper end face 10*a* of the ink container body 10 with the first fixing portions 30*b* respectively engaged with the grooves 14 and the second fixing portion 30*c* engaged with the projection 15. The second fixing portion 30*c* is formed of material which is somewhat flexible to allow the second fixing portion 30*c* to be deformed to be engaged with the projection 15.

Figure 11:
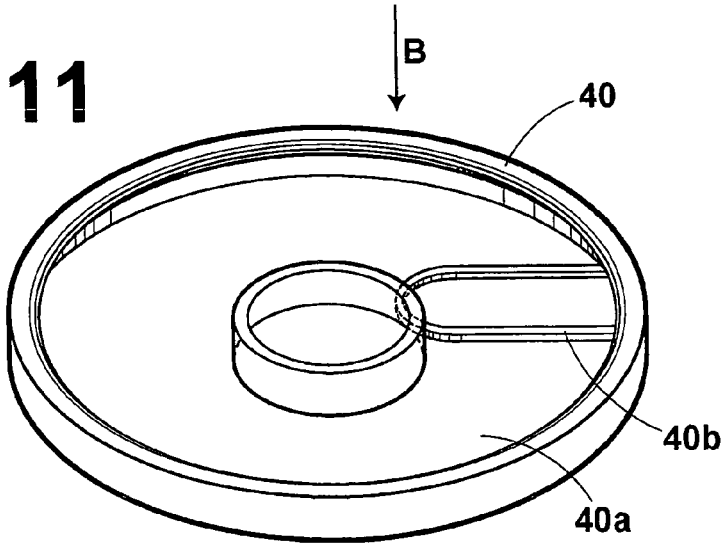
FIG. 11 is a perspective view showing a still another embodiment of the present invention.
Figure 12A:
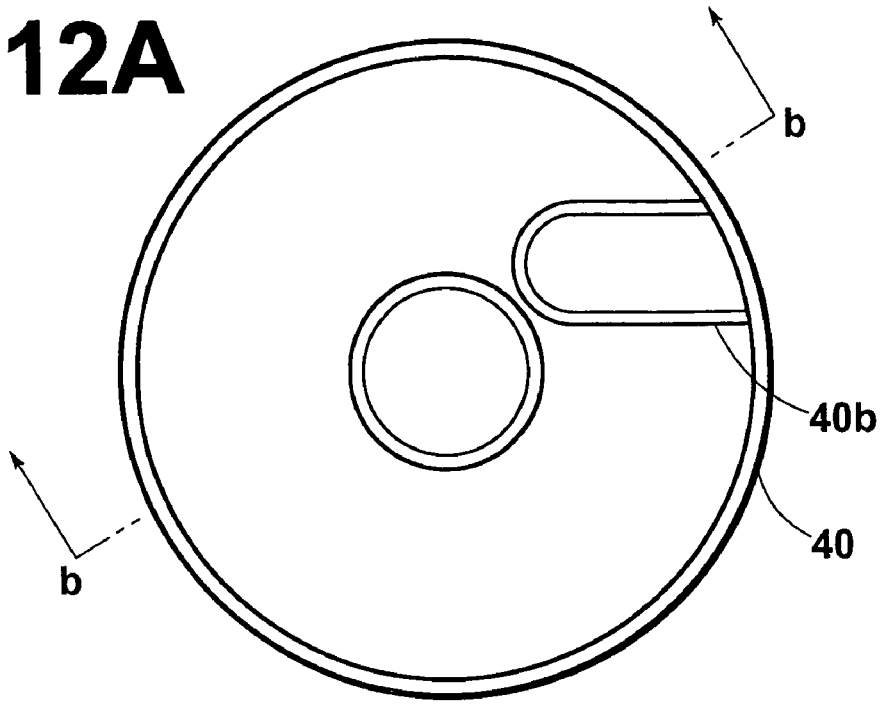
FIGS. 12A and 12B are a plan view and a fragmentary cross-sectional view for illustrating the mounting member shown in FIG. 11.
Figure 12B:
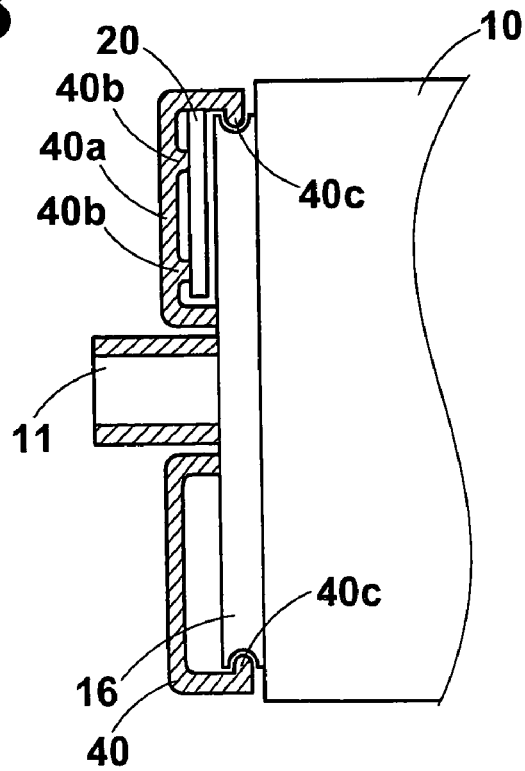

The storage means 20 may be mounted on the ink container body 10 by way of a donut-like mounting member 40 shown in FIG. 11. That is, the mounting member 40 comprises a donut-like disk and a rib 40*b* on the inner surface 40*a* of the disk. The storage means 20 is provided on the rib 40*b* and the mounting member 40 is removably mounted on the ink container body 10. FIG. 12A is a view of the mounting member 40 as viewed in the direction of arrow B in FIG. 11 and FIG. 12B is a cross-sectional view taken along line b—b in FIG. 12A of the mounting member 40 when the mounting member 40 is mounted on the ink container body 10 with the storage means 20 provided on the rib 40*b*. As shown in FIG. 12B, the mounting member 40 is provided with protrusions 40*c* and the mounting member 40 is removably mounted on the ink container body 10 by bringing the protrusions 40*c* into engagement with recesses formed on a part 16 of the ink container body 10. Though, in this embodiment, the mounting member 40 is removably mounted on the ink container body 10 by press fitting, the mounting member 40 may be removably mounted on the ink container body 10 by other various methods. For example, the mounting member 40 may be removably mounted on the ink container body 10 by screwing. Further, the shape of the mounting member need not be limited to the illustrated shape but the mounting member may be of any shape so long as it can be removably mounted on the ink container body 10.

Further, though, in the embodiments described above, the memory site 10*b* is provided on an upper end face 10*a* of the ink container body 10*a*, the memory site 10*b* may be provided on any part of the ink container body 10.

Further, though, in the embodiments described above, the ink container body 10 is substantially cylindrical in shape, the ink container body 10 may be of any shape.

What is claimed is:

1. An ink container comprising an ink container body and a storage means attached to the ink container body for storing predetermined information, wherein the storage means is bonded to a part of the surface of the ink container body having a periphery that is accessible to a removal member, wherein the storage means is bonded at its surface opposed to the surface of the ink container body over an area not larger than 90% of its surface facing toward said part of the surface of the ink container body.

2. An ink container as defined in claim 1 in which storage means is bonded to the part of the surface of the ink container body by an adhesive, the adhesion of the adhesive is 20N/25 mm and at the same time, the storage means is bonded to a part of the surface of the ink container body at its surface opposed to the surface of the ink container body over an area not smaller than 30% and not larger than 90% of its surface facing toward said part of the surface of the ink container body.

3. An ink container as defined in claim 1 in which a part or the whole of outer periphery of said surface of the storage means facing toward the part of the surface of the ink container body is not bonded to the surface of the ink container body.

4. An ink container as defined in claim 1 in which the storage means is bonded to the part of the surface of the ink container body by an adhesive with a bond strength between 3.8N and 10.5N.

5. An ink container comprising an ink container body and a storage means attached to the ink container body for storing predetermined information, wherein the storage means is bonded to a surface of the ink container body having a periphery that is accessible to a removal member, wherein the storage means is bonded at its surface opposed to the surface of the ink container body by way of a protrusion means which is smaller in area than a surface of the storage means facing toward the part of the surface of the ink container body.

6. An ink container as defined in claim 5 in which the protrusion means comprises a plurality of ribs formed at predetermined spaces from each other.

7. An ink container as defined in claim 6 in which the ribs are rounded at least one of the end portions respectively in contact with the ink container body and the storage means.

8. An ink container as defined in claim 5 in which the protrusion means comprises a plurality of projections which are brought into contact with the ink container body or the storage means at a point.

9. An ink container as defined in claim 8 in which the projections are rounded at least one of the end portions respectively in contact with the ink container body and the storage means.

10. An ink container as defined in claim 5 in which the protrusion means is absent in positions opposed to a part or the whole of outer periphery of said surface of the storage means facing toward the part of the surface of the ink container body.

11. An ink container comprising an ink container body and a storage means attached to the ink container body for storing predetermined information, wherein the storage means is mounted on the ink container body by way of a removable mounting member having a plurality of protrusions that engage a plurality of narrow elongated grooves on the top of the ink container body.

12. An ink container as defined in claim 11 in which the removable mounting member's plurality of protrusions extend from a bottom surface of the mounting member.

* * * * *